United States Patent [19]

Johnson

[11] 4,085,863

[45] Apr. 25, 1978

[54] MAP VENDING MACHINE

[76] Inventor: Ralph S. Johnson, 907 Frontier Park Ave., Cheyenne, Wyo. 82001

[21] Appl. No.: 602,829

[22] Filed: Aug. 7, 1975

[51] Int. Cl.[2] ..... G07F 11/16

[52] U.S. Cl. ..... 221/20; 221/215; 221/232; 221/279; 221/304

[58] Field of Search ..... 221/18, 19, 20, 151, 221/152, 213, 232, 259, 267, 279, 241, 304, 307, 303, 214, 215

[56] References Cited

U.S. PATENT DOCUMENTS

| | | | |
|---|---|---|---|
| 893,394 | 7/1908 | Spangler | 221/279 |
| 1,186,887 | 6/1916 | Cooley | 221/303 X |
| 1,257,153 | 2/1918 | Turney | 221/267 X |
| 1,587,114 | 6/1926 | Goudeau | 221/267 X |
| 2,263,040 | 11/1941 | Kaltenbach | 221/213 |
| 2,501,434 | 3/1950 | Cameron | 221/232 X |
| 2,673,133 | 3/1954 | Koch | 221/152 X |
| 2,681,842 | 6/1954 | Rabkin et al. | 221/152 X |
| 3,136,451 | 6/1964 | Deane | 221/241 X |
| 3,872,997 | 3/1975 | Armstrong et al. | 221/20 |
| 3,917,113 | 11/1975 | Light | 221/20 |
| 3,957,175 | 5/1976 | Gordon | 221/215 |

*Primary Examiner*—Robert B. Reeves
*Assistant Examiner*—Joseph J. Rolla
*Attorney, Agent, or Firm*—John E. Reilly; Earl C. Hancock

[57] ABSTRACT

Folded documents are singly fed from the bottom of a stack by an ejector having a pin, hook or catch along one edge which moves below the bottom of the stack and is selectably slidable so as to engage the lowermost document. The lowermost document is slidingly delivered through an aperture by the ejector which, in one embodiment, grips the rear edge of the document while, in other embodiments, the bottom surface of the lowermost document is embedded with a pin or otherwise frictionally engaged. An adjustable slide restrictor plate can be positioned so as to prevent more than one document from exiting from a slot while permitting sufficient vertical motion of the plate so as to accommodate variable document thicknesses such as from folding irregularities associated with the document being ejected. An additional plate follows the top of the document stack and includes an engaging stub to prevent machine actuation when the stack has been depleted. A pendulously mounted follower weight can be included to assist in proper document feeding.

17 Claims, 17 Drawing Figures

MAP VENDING MACHINE

BACKGROUND OF THE INVENTION

This invention relates to apparatus for dispensing items from a source of supply in response to actuation of a selector mechanism. More particularly, this invention is concerned with vending machine apparatus particularly useful for dispensing folded documents such as maps and the like in response to actuation via a coin-operated apparatus.

In the past, vending machines have been developed for producing prepackaged products such as candy, gum, and other items. Many such devices employ standard sized cells or plunger mechanisms which drop the item into a bin accessible to the front of the machine. Although useful for prepackaged items of various sorts, such vending machines are not well suited for supplying folded documents such as maps, newspapers and the like. Typical apparatus for newspaper vending permits access to the entire newspaper supply. Although such apparatus can be reasonably employed for low cost items such as newspapers, such a system for more expensive document dispensing such as maps is not acceptable.

SUMMARY OF THE INVENTION

The present invention provides an apparatus which is capable of accommodating documents having a variety of potential thicknesses and widths. The present invention is well suited for utilizing state-of-the-art coin operated plungers for actuating a slide ejector which moves across the lower area of a stack of documents. In one embodiment of the invention, the ejector includes a catch arrangement which is adjustable to grasp a document at slightly less than its thickness so as to slide the document from the bottom of a stack. In other embodiments, the ejector has a pin or stub which can be embedded in or otherwise frictionally engage the bottom surface of the lowermost document for sliding it from the stacks. The stack is retained in position by an advantageous cooperation between an adjustable front plate and a weight plate on the top of the stack. The adjustable plate is preset to permit the leading edge of only one document to exit through an aperture or is spring-biased towards the aperture but is movable so as to accommodate variations in thickness of the document selected as it is being ejected or otherwise withdrawn from the machine. Ejection of documents other than the lowermost document of a stack is prevented by this restrictor plate. The weight plate insures that the uppermost document of the stack will remain flat and that the stack will have sufficient weight to insure continuous downward feeding. The weight plate also can include a catch arrangement for preventing further operation of the machine once the entire stack of documents has been depleted. One or more pendulum arrangements can also be included to cooperate with the weight plate to further insure proper document feeding and/or stop mechanism operation.

Accordingly, it is an object of this invention to provide a manually operable vending machine for documents such as maps and the like.

Another object of this machine is to provide a document dispensing apparatus which can be adjusted to accommodate documents of different dimensions.

A further object of this invention is to provide a coin actuated map vending machine.

A still further object of this invention is to provide a manually operated folded document vending machine which can accommodate documents having different thicknesses.

The foregoing and other objects, features and advantages of the present invention will be apparent in view of the following description of the preferred embodiments.

DETAILED DESCRIPTION OF THE PREFERRED EMBODIMENTS

Figure 3:
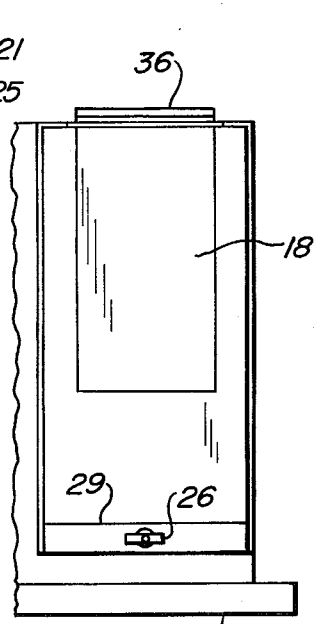
FIG. 3 is a top view of the FIG. 1 embodiment.
Figure 2:
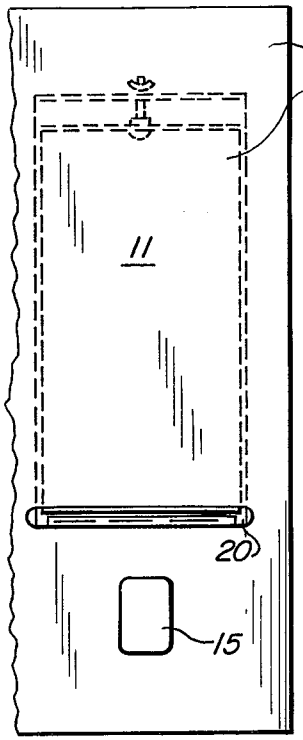
FIG. 2 is a front view of the FIG. 1 embodiment.
Figure 1:
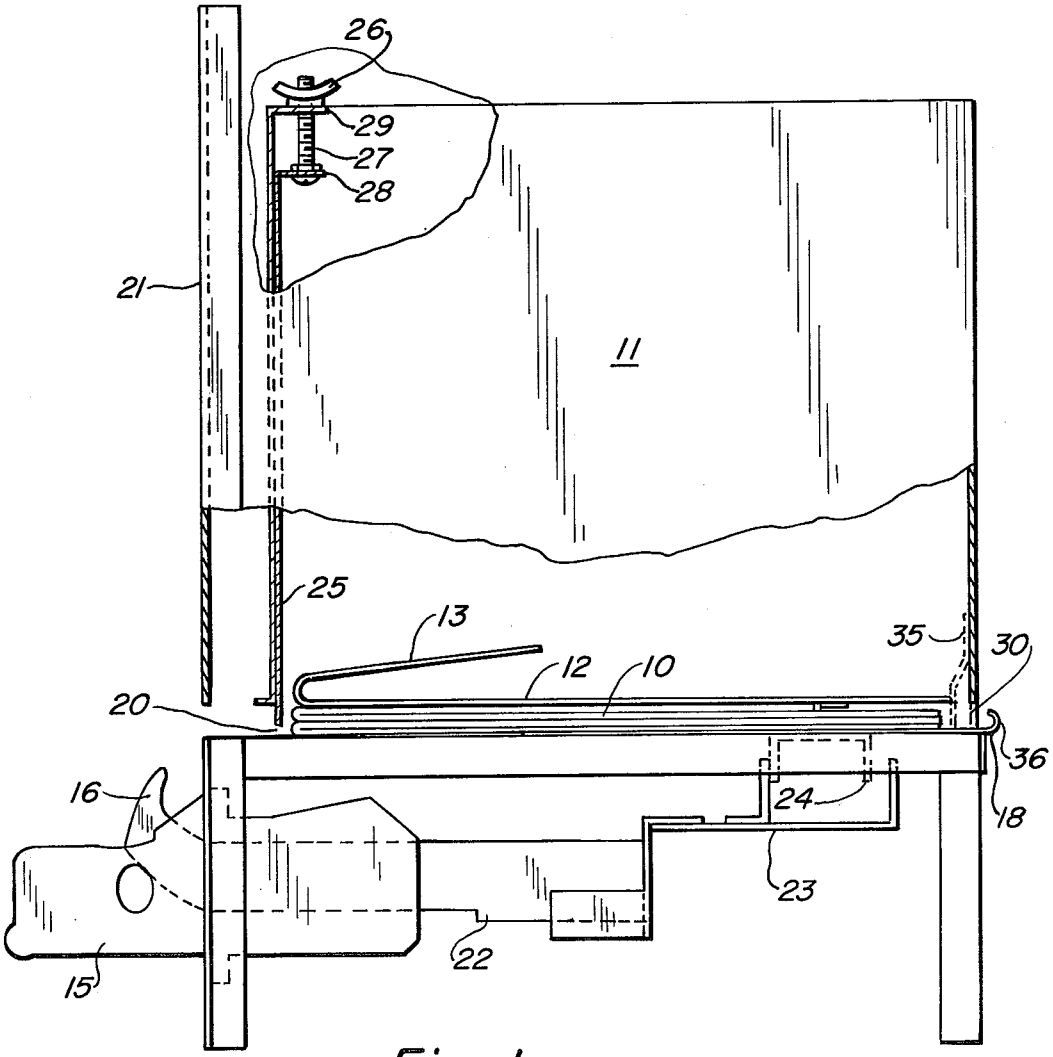
FIG. 1 is a partially sectioned side view of a preferred embodiment of this invention.

The preferred embodiment of FIGS. 1–8 will be described in conjunction with one map vending unit but it will be readily understood that several such vending units may be encased within a common housing. As seen in FIG. 1, a plurality of folded documents such as maps 10 are stacked in a map basket or container 11 and a weight plate 12 is placed on top of the stack of documents. A state-of-the-art coin actuated mechanism 15 is positioned to accept coins and, in response to manually moving handle 16, the mechanism slides fully towards the face as shown in FIG. 1 and can then be withdrawn fully as is well known thus providing one cycle of reciprocating motion. This causes the generally flat ejector plate 18 to initially slide rearwardly along the bottom of the container 11 beneath the lowermost document until J-hook shaped catch edge 36 thereof has passed completely out from under stack 10 as shown in FIG. 1. Thereafter, ejector 18 contacts the back edge of the lowermost map in stack 10 as plate 18 begins its forward movement and thus urges this document forward emitting it at slot 20 in the front of the machine. Manual mechanism 15 has a plunger arm 22 extending therefrom with a U-shaped section 23 which imparts reciprocating sliding motion to ejector 18 by engaging lower U-shaped extensions 24 thereof.

In order to prevent the machine from ejecting several folded documents from stack 10 at the same time through slot 20, slide restrictor plate 25 can be adjusted by operating wing nut 26 so as to vertically position plate 25 thus preventing a second document from being ejected from stack 10 for each actuation of mechanism 15. Restrictor plate 25 is attached to bolts 27 at the angle edge 28. However, bolt 27 and wing nut 26 are free to move vertically upward in angled edge 29 of the main frame. This means that the upper surface of shoulder 29 and the lower shoulder of wing nut 26 cooperate to provide a lower stop for vertical movement of plate 25 while allowing selectable adjustment of the location of this stop. Accordingly, slide restrictor plate 25 is free to move upward since some folded documents such as maps may have a variable thickness as they are being withdrawn from the machine. A proper setting of the vertical stop for slide restrictor plate 25 permits the leading edge of the bottom map to slide freely beneath it through opening 20.

A display (not shown) can be included on the front panel 21 of the machine which illustrates the document which is available. Basket container 11 is filled with this specific document and the slide restrictor plate 25 adjusted via wing nut 26 to permit the leading edge of the lowermost map in stack 10 to be passed through opening 20. As mentioned, the entire machine can consist of several assemblies each capable of ejecting documents and thus the entire machine may be able to supply a range of specific maps or other documents.

Map ejector plate 18 is moved by slide arm 22 of the coin operated mechanism 15 and is shown in the drawings in the full rear position which is attained after coins have been inserted into mechanism 15 and the operating handle 16 pressed to the full rear position. As illustrated in this apparatus, the hook section of ejector 18 protrudes beyond slot 30 in the back of the case passing out from underneath the bottom document in stack 10 which is restrained from moving backward by the rear of the case. Thus, when ejector 18 moves forward, the hook section contacts the rear of the lower document and thus it is drawn forwardly causing the initial portion of the document to protrude beyond aperture 20. The operator may then grasp the document and withdraw it completely from the machine. The next map of stack 10 then falls down upon ejector 18 and rests on it until the coin mechanism 15 is again actuated.

Note that documents in stack 10 essentially lie flat on ejector plate 18 when it is in the forward or normal position. This means the documents do not become distorted as they would in machines that use continuously upward projections for ejecting documents. The ejector 18 hook section 36 is preferably designed so that contact is made with the upper half of the folded document which causes the document to slide beneath the document immediately above it in the stack 10. This causes the nose of the lower document to tend to force downward whereas, if ejector 18 contacted the lower half of the folder document it may tend to cause the nose of that document to rise and contact restrictor plate 25 and thus cause some difficulty in ejecting the document. The height of the hook for ejector plate 18 is controlled so that is does not contact the document above the lower document and tend to move it forward. It is unique in the map vending art that the ejector 18 hook contact the map at the rear and carry the map forward on the plate 18 for ejection.

Figure 4:
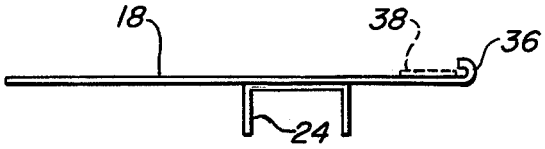
FIGS. 4 and 5 are views of the slide ejector for the FIG. 1 embodiment.
Figure 5:
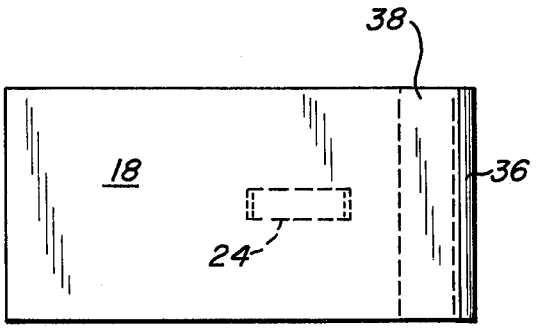
Figure 8:
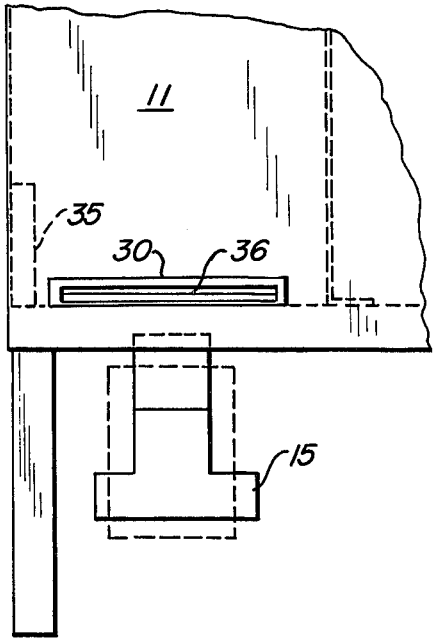
FIG. 8 is a rear view of the FIG. 1 embodiment.

Although it has been noted that it is preferable to include rear slot 30 for allowing the hook section of plate 18 to protrude beyond the rear surface of the case, it will be further appreciated that a limiter 35 as shown in phantom in FIGS. 1 and 8 can be included on each side of the rear of the basket container 11 to hold the documents somewhat forward so as to permit the hook section of ejector 18 to move beyond the rear of the lowermost map but still stay within the case. As can be seen in FIGS. 4 and 5, the height of the hook section 36 for ejector plate 18 can be controlled to contact the upper half of the folded document clear of the bottom of the document immediately above it in stack 10. This can be effected by adding a pad strip 38 along the flat surface of plate 18 immediately in front of hook section 36 when thinner documents must be handled. Of course the thickness of pad 38 depends entirely upon the thickness of the document to be handled and the height of the leading edge of the hook 36 above the plane of flat ejector plate 18.

Figure 6:
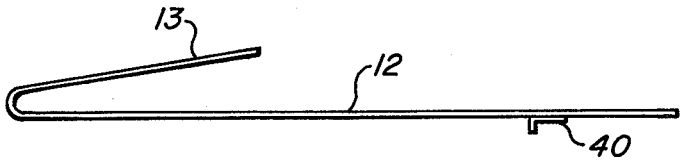
FIGS. 6 and 7 are views of the weight or follower plate for the FIG. 1 embodiment.
Figure 7:
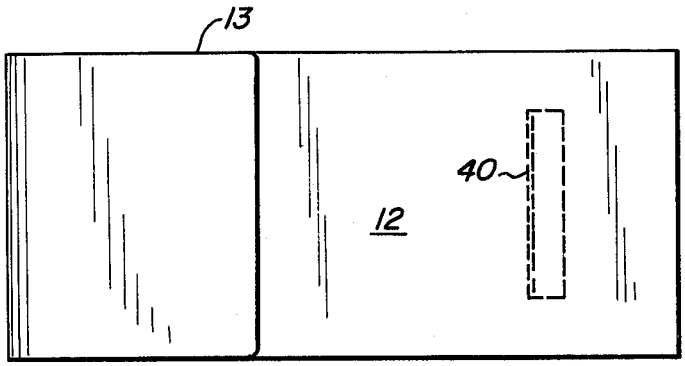

FIGS. 6 and 7 show the construction of the follower panel 12. In addition to retaining the upper document flat, panel 12 provides weight on the top of the document stack 10 and insures proper feeding of the documents when the stack is nearing depletion. This insures that the last document to be ejected will be appropriately in position and properly aligned for ejection. Further, a stop bar 40 on the lower side of the surface of panel 12 is arranged so that, after the last document has been ejected, it will fall between the rear wall of container 11 and hook section 36 of ejector plate 18 and thus prevent movement of lever 16. This informs the user that the stack has been fully depleted and does so in a manner which permits recovery of coins from the mechanism.

Figure 9:
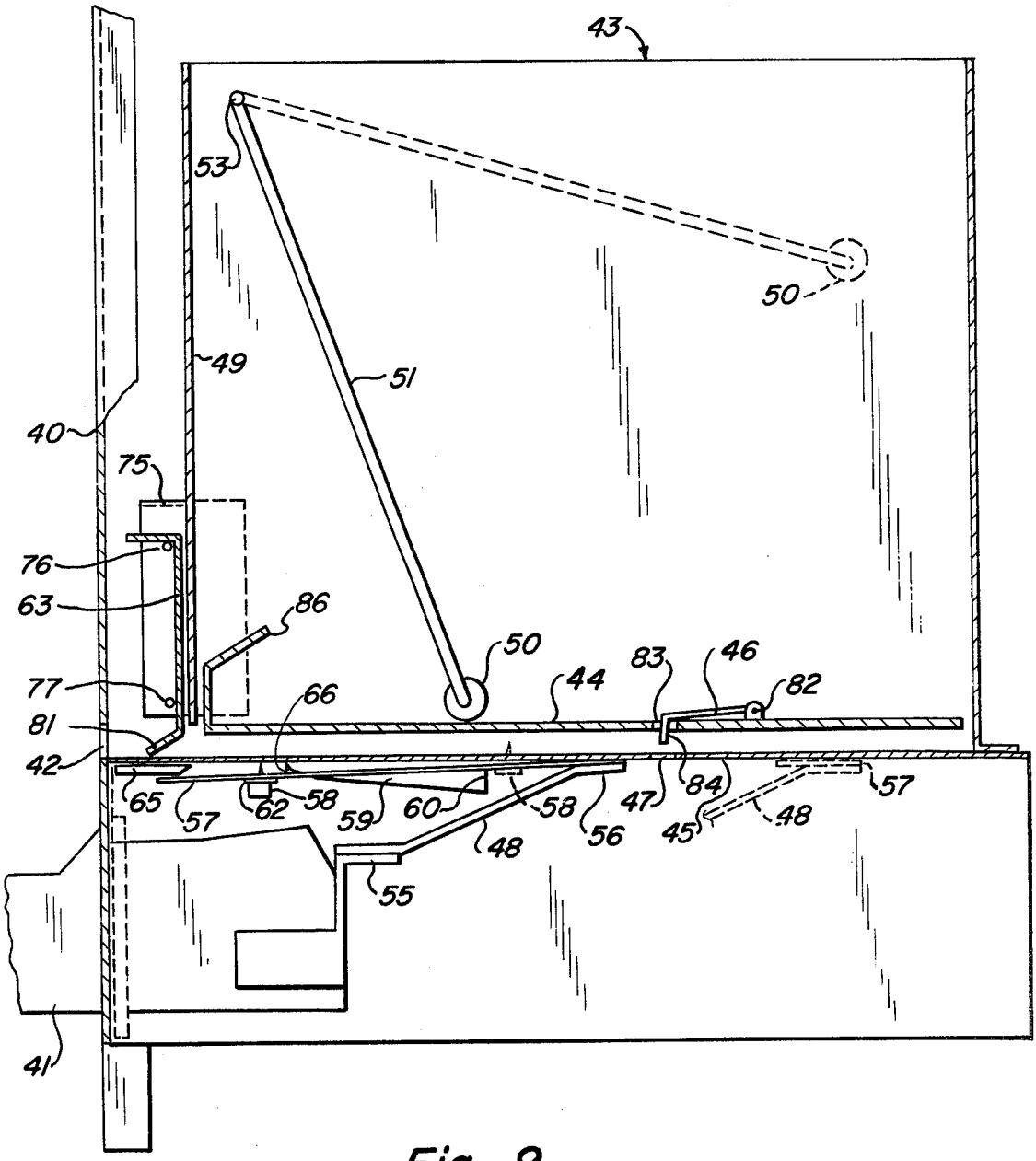
FIG. 9 is a partially sectioned side view of a second embodiment of this invention.

A second embodiment of a map vending apparatus in accordance with the present invention is shown in side view in FIG. 9 with the side panels of the overall enclosure being either removed or shown in broken sections. As with the FIG. 1 embodiment, a front panel 40 has a coin-actuated mechanism 41 accessible from the front thereof and an elongated aperture 42 through which maps are ejected. Further, the FIG. 9 embodiment has a document bay 43 somewhat similar to that employed in the FIG. 1 embodiment and includes a weight plate 44 for generally the same function as described previously. That is, when the document supply has been depleted, weight plate 44 will drop down onto lower floor 45 with the pivoted pin 46 dropping through port 47 so as to block any backward movement of connecting arm 48 of the coin mechanism 41.

Figure 15:
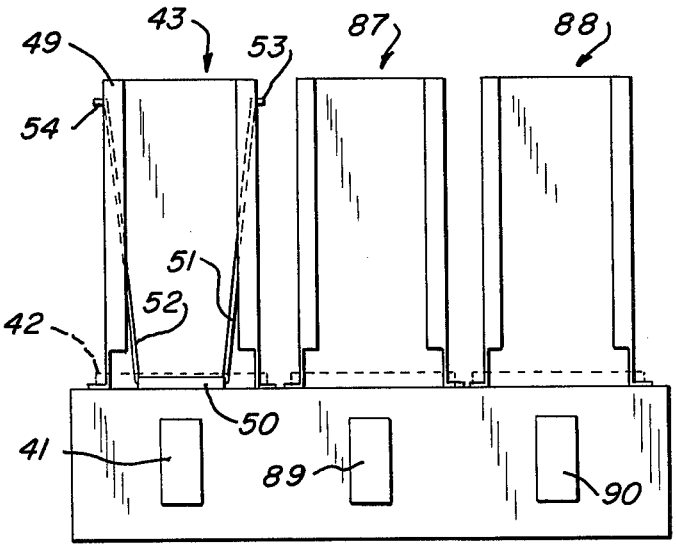
FIG. 15 is a view of a multiple bay dispenser with the front panel removed.

The document bay 43 has a slotted front wall 49 which permits ready access by removing the upper portion of the front panel 40 as is illustrated in FIG. 15. To further augment a flattening of the document to be dispensed by weight plate 44, an additional weight bar 50 is mounted in a pendulous fashion by arms 51 and 52 so as to increase the downward pressure on the uppermost document of the stack as the stack is depleted. The pendulum mounting arrangement for weight bar 50 can be seen in both FIGS. 9 and 15, the side arms 51 and 52 being pivotally attached through the side walls of bay 43 at 53 and 54.

The actuator arm 48 is rigidly attached at one end to the coin actuated mechanism at 55 and is further rigidly attached at 56 to an elongated strip 57 of spring steel or the like which has a pin assembly 58 retained therein. FIG. 9 shows the strip 57 and pin assembly 58 in its fully forward position whereas the full rearward positions thereof are generally indicated by the dotted position of actuator arm 48, pin 58 then being positioned as is also shown dotted in FIG. 9. The spring metal plate or strip 57 is in the position shown in FIG. 9 prior to insertion of coins into mechanism 41. When coins have been inserted in mechanism 41 and the lever arm pushed inward, shoulder bar 62 on pin assembly 58 will follow ramp 59 until it reaches the innermost edge 60 at which point pin 58 will be snapped upwardly through slot 61 in floor 45 as shown dotted in FIG. 9 and thence engage the lowermost document in the stack. The shoulder bar 62 attached to pin assembly 58 slides forwardly parallel with the floor 45 as the mechanism is pulled outwardly at 41 thereby forcing the leading edge of the document beneath the restricter plate 63. Ultimately, the leading edge or tongue 64 of ejector plate 57 will be forced downwardly by its engagement with cam block 65. As will be described below, the ramp arrangement 59 insures that pin assembly 58 will remain in proximity to the floor 45 until after shoulders 62 have passed beyond the leading edge 66 of the ramp assembly. At that point, pin 58 will be sprung downwardly so as to completely disengage from the document which can then be manually withdrawn the remainder of the distance through aperture 42.

Figure 11:
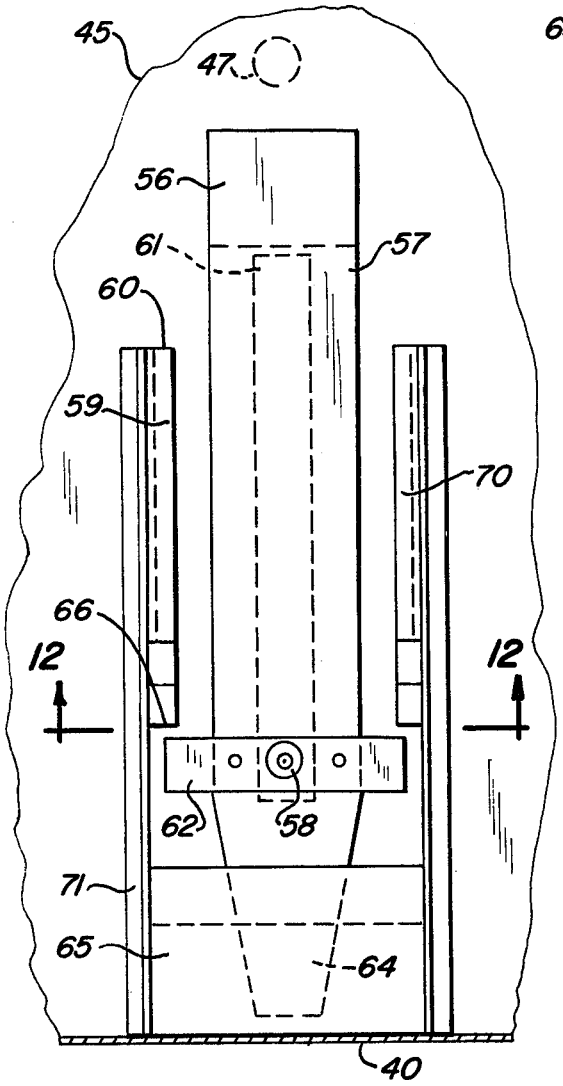
FIGS. 11 and 12 are views of the pin mounting mechanism for the FIG. 9 embodiment.
Figure 12:
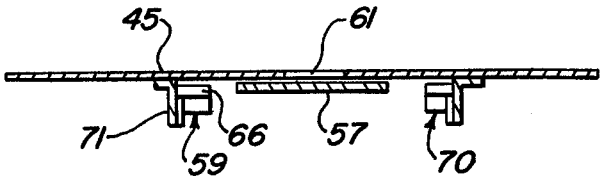
Figure 14:
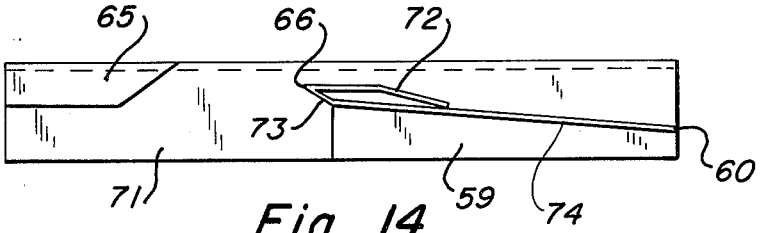
FIG. 14 is a side view of the ramping structure useful with the FIG. 9 embodiment.

FIG. 11 shows the arrangement of ejector plate 57 as it would be seen looking downward from the floor 45 of the bay 43. Although floor 45 is shown broken away in FIG. 11 in order to more clearly show the other elements of the ejector mechanism, slot 61 which accommodates the tip of needle 58 through floor 45 and the actuator stop bar bore 47 are shown dotted in FIG. 11 to correlate their interrelationship with the other elements. In order to minimize obstruction of the view of the spring plate 57, only one ramp assembly 59 is shown in FIG. 9 whereas both ramps are visible in FIGS. 11 and 12. It is to be understood that ramp assembly 70 which is visible in FIGS. 11 and 12 is essentially the same as ramp assembly 59 except a mirror image thereof. The detail of ramp assembly 59 is shown in FIG. 14 wherein a main L-member 71 is employed for axially affixing ramp assembly 59 to the floor 45. The ramp assembly 59 is preferably fabricated from an additional L-member with the front portion cut away so that section 72 thereof can be bent backwards against itself as best seen in FIG. 14. As shoulder 62 is moving towards the front of the dispenser, it will be engaged by spring shoulder 72 to retain it in proximity to floor 45 despite the initial upward bending of tongue 64 for plate 57 against cam block 65. Thus, when the pin assembly 58 has passed beyond the leading edge 66 of assembly 59, it will spring downwardly into the orientation shown in FIG. 9. Thereafter, rearward movement of shoulders 62 will engage the lower surface 73 of assembly 59 and thus be sprung further downwardly by the ramp surface 74 until it ultimately passes beyond the rear edge 60.

Reviewing briefly, guide shoulder 72 and its counterpart on ramp assembly 70 cooperate with shoulder bar 62 to insure that the pin of assembly 58 protrudes completely through slot 61 of floor 45 and engages the document for all but the last segment of the second half of a reciprocating cycle of actuator 41. As the last motion segment is entered, shoulder 62 moves beyond leading edge 66 of ramp assembly 59 as well as the equivalent leading edge of ramp assembly 70 on the opposite side. The downward springing action at that point effects disengagement with the lower portion of the document which has been ejected so as to extend beyond the front of plate 40 through aperture 42 so that it can be grasped and removed without interference from the pin. Further, the action of leading surface 73 and ramp 74 along with their counterparts for ramp assembly 70 additionally insure that the pin of assembly 58 will not inadvertently engage the next document while it is being moved rearwardly. Pin 58 is accordingly held clear of the lowermost document for all but the last segment of the first half of the reciprocating motion of actuator 41.

Figure 10:
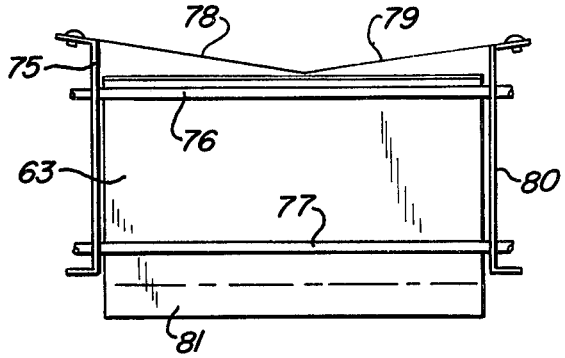
FIG. 10 is a front view particularly showing the detail of the restrictor plate for the FIG. 9 embodiment.

Restrictor plate 63 which is best seen in FIGS. 9 and 10 is mounted between a pair of end plates 75 and 80 while being movably retained parallel to the front wall 49 by two spaced cross bars 76 and 77. Restrictor plate 63 is generally free to move in a vertical plane although it is biased downward by a pair of spring assemblies 78 and 79 attached between mounting brackets 75 and 80. Plate 63 has an outwardly bent lower edge or lip 81 which permits the document to move plate 63 upward to the extent necessary to permit the document to be forced through aperture 42. However, the weight of the spring biasing on plate 63 will prevent any upper document which is not actually engaged by pin assembly 58 from being inadvertently ejected and retain it in position for the next actuation of the mechanism. Note that spring elements 78 and 79 which are omitted from FIG. 9 can be provided functionally by other apparatus if desired.

Figure 13:
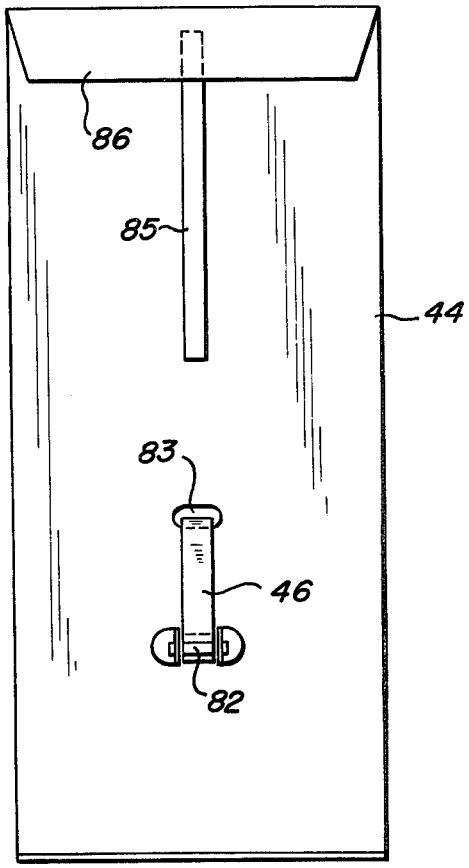
FIG. 13 is a top view of a weight plate for the FIG. 9 embodiment.

FIG. 13 shows an upper view of the weight plate 44 which includes a stop pin 46 pivotally attached to bar 82 so as to extend downwardly through slot 83. As can be seen in FIG. 9, the exhaustion of documents from bay 43 causes the leading edge 84 of the pin 46 to drop through port 47 so as to block any additional rearward movement of actuator arm 48. FIG. 13 further illustrates an additional slot 85 in weight plate 44 which accommodates the pin of assembly 58 in the event that the document stack becomes exhausted. That is, any failure of the coin actuator mechanism 41 to be blocked by stop bar 46 and any further actuation thereof will not result in damage to pin 58 because of the existence of slot 85. The bent leading edge 86 of plate 44 facilitates grasping for removal when new documents are to be inserted in the bay 43 and also prevent plate 44 from slipping under front wall 40 into aperture 42.

FIG. 15 illustrates an arrangement wherein three bays 43, 87 and 88 are contained on the same common base with their separate coin actuator mechanism 41, 89 and 90. The view as shown in FIG. 15 has the upper front panel assembly completely removed and the restricter plate arrangements omitted, but illustrates the slotted opening arrangement of each bay for recharging. It will be understood that a similar arrangement can be employed in conjunction with the FIG. 1 embodiment.

Reviewing briefly the various features of the second embodiment, the needle assembly 58 is arranged to penetrate the underside of the lowermost document in a stack within the bay. By using a relatively small needle, this engagement can cause minimal damage to the document yet engage it with sufficient strength to eject it through the restricter plate and aperture. Note that devices other than an impacting needle could be used such as a friction engaging foot or the like in place of the sharp point if this should be desirable. Also the needle of assembly 58 can be vertically adjustable to accommodate documents of differing thicknesses. However the mechanism permits sudden penetrating at the far end of the coin actuator travel and sudden retraction at the other end. The document can be withdrawn without contacting the needle or friction-engaging arrangement so as to avoid scratching of the document. The documents are maintained in a flat orientation from the chute floor and are prevented from becoming distorted. The "sold-out" restricter in cooperation with the weight plate 44 rests upon the maps and prevents cycling of the coin mechanism when the documents are depleted. The weight plate can be of relatively lightweight material such as 20-gage steel. The pendulum weight facilitates the maintenance of the document in flat orientation yet can be easily pivoted out of the way for loading the chute. The map restricter at the front of the chute restricts the maps resting above the one on the bottom from being ejected concurrently with the lowermost document. The maps contact the inclined face 81 of restrictor 53 causing it to rise during ejection of the map but producing restriction by virtue of the restrictor's weight and spring-biasing with this restraining force preventing additional document ejection. The ejector mechanism can be mounted in a slide support and need not be fully supported by the actuator arm 48 of the coin mechanism. That is, additional edge guide means for a portion of ejector plate 57 could be included if desired so that a relatively loose connection similar to that shown in FIG. 1 can be maintained between actuator arm 48 and plate 57.

In a typical practical arrangement of the FIG. 9 embodiment, the document bay may be approximately 9¼ inches deep by 4¼ inches wide with ½ inch shoulders on the front plate 49. With a linear travel of approximately 3 inches for the coin actuator mechanism 41, the ramp arrangements 59 and 70 may typically be 2¼ inches in length with approximately 7/32nds leading shoulder 73, the folded-back shoulder 72 extending for approximately 1 inch total. The distance between the rear edge 60 and the floor 45 generally will be approximately ¼ inch. The mounting frame 71 might be 4½ inches with the leading edge ramp or cam plate 65 having an approximately ¾ inch flat portion, ¼ inches height and about a 30° slope on the cam surface relative to the floor 45.

Figure 16:
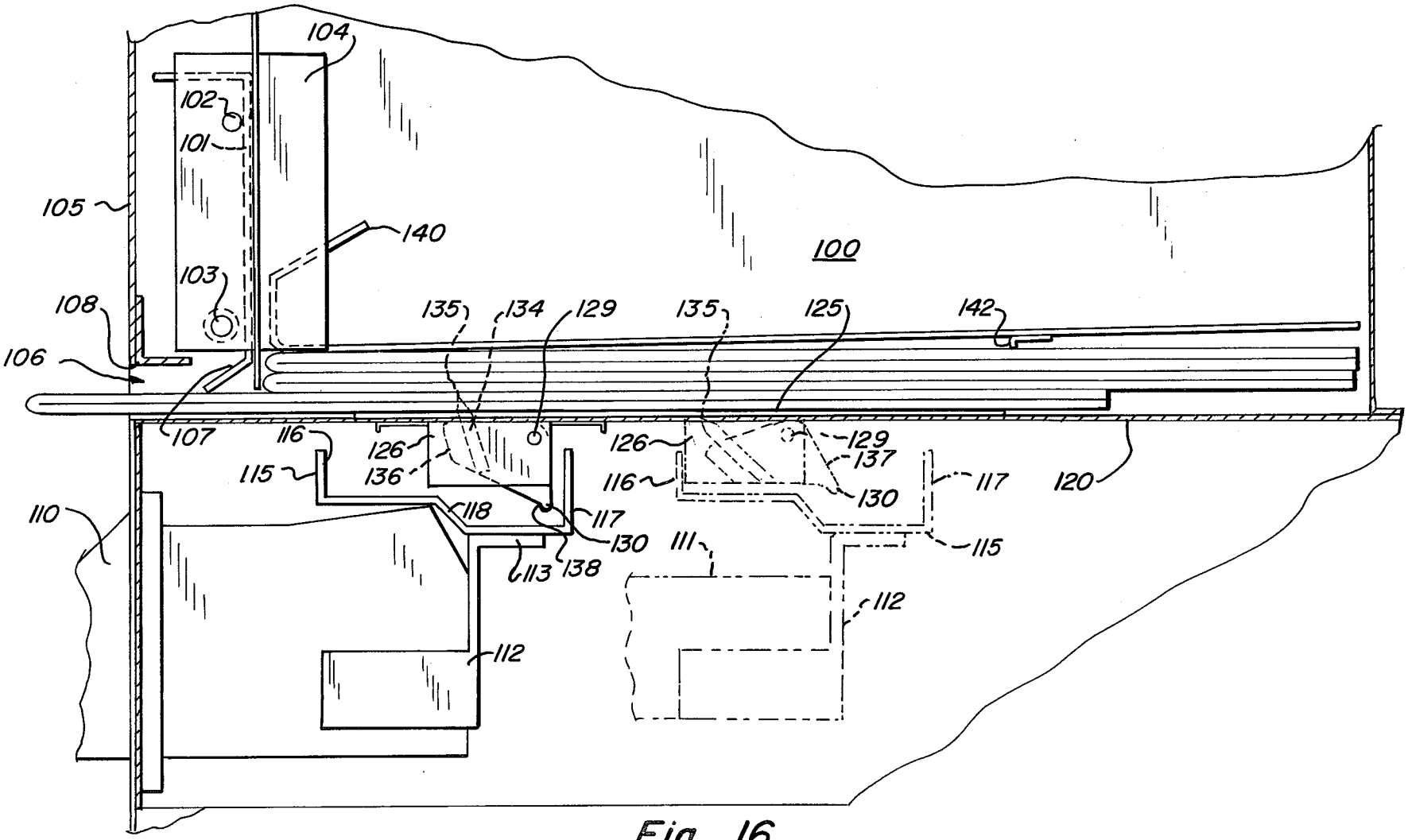
FIG. 16 is a partially sectioned and broken side view of a third embodiment of this invention.
Figure 17:
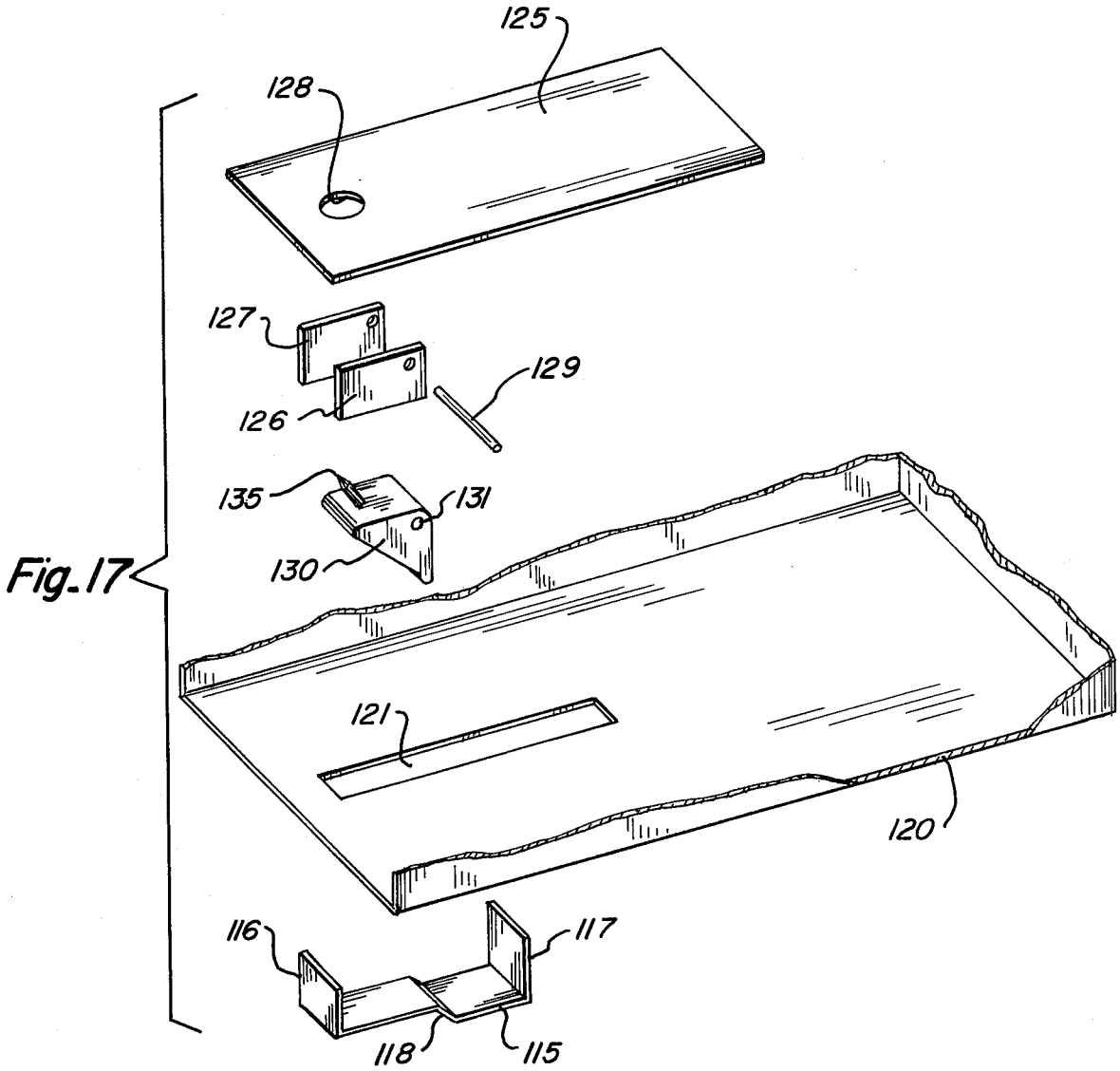
FIG. 17 is an exploded view of the mounting arrangement for the pin ejector elements of FIG. 16.

A third potential embodiment for implementing this invention is shown in FIGS. 16 and 17. This embodiment is somewhat similar to that described above for FIG. 9 in that it uses a pin for impacting the lowermost document of a stack although once again it should be recognized that the pin can be replaced by other frictional engaging apparatus if desired. The document stack receiving bay 100 has a spring-biased restrictor plate 101 along the front thereof which is retained by bars 102 and 103 between a pair of end plates such as 104. Restrictor plate 101 and its mounting assembly can be substantially the same as that described herein before in FIGS. 9 and 10 for restrictor plate 63.

The front cover 105 of the device has an ejector slot 106 with the angled lower surface 107 of ejector plate 101 normally closing this slot 106. A channel bar or beam 108 of an L-shaped cross-section is attached along the lower edge of front panel 105 and extends rearwardly towards the leading edge 107 of restrictor plate 101. This arrangement further ensures that documents being ejected from bay 100 will be accurately guided out of slot 106.

As with the other embodiments, a coin enabled manually operable apparatus 110 is included on the front of the assembly and has a reciprocating lever arm or slide arm 111 attached thereto. A bracket member 112 is rigidly attached to the rear face of slide arm 111 and further has bracket 115 rigidly attached along the upper arm 113 thereof as shown. Bracket 115 has upwardly extending end arms 116 and 117 for purposes to be described below and further includes a central bend so as to define sloped surface 118 intermediate of the lower portion.

The floor 120 of bay 100 has a slot 121 therethrough as can best be seen in the exploded view of FIG. 17. A slide plate 125 has a pair of side plates 126 and 127 rigidly attached thereto in downwardly extending relation on either side of bore 128. A pivot pin 129 is passed through holes in each of side plates 126 and 127 and also through bore 131 of pin mounting block 130. Thus the entire assembly of side arms 126 and 127 with block 130 pivotally attached on rod 129, all in downwardly extending fixed relation on slide plate 125, fits within slot 121 of floor 120 so as to extend therethrough as is more clearly seen in FIG. 16.

The two extremes of travel and operating interrelationships of the ejector pin apparatus are shown in FIG. 16. Mounting block 130 retains a shank 134 therethrough which terminates in a needle point 135. A set screw (not shown) extending into block 130 from front face 136 thereof can be included to clamp shank 134 in place. The set screw can be loosened to permit adjustment of the vertical positioning of the needle shaft 134 or replacement of that needle. It should be recognized that the relationships between bracket 115, plate 125 and needle 135 as depicted in solid lines in FIG. 16 is shown as it would be when the lowermost document from a stack had been forced so that the leading edge thereof extends outwardly from aperture 106 as illustrated. The needle at that point is embedded in the bottom document. As the document is pulled outwardly from aperture 106, block 130 pivots around rod 129 and drops downwardly into the position shown in phantom lines on the right in FIG. 16. Any tendency of plate 125 and pin 135 to continue sliding towards aperture 106 as the document is being withdrawn is blocked by sloped surface 118 of bracket 115 engaging the lower surface of block 130 and thus effecting document disengagement by pin 135 via rotation about pin 129.

Actuation of the slide arm 111 in the first portion of a reciprocating cycle (i.e.: extending rearwardly into the device) causes shoulder 116 to engage the front edges of side plates 126 and 127 thus moving the entire pin block 130 rearwardly with the needle point 135 being below floor 120 and clear of the lowermost document. Upon completion of the first half of the reciprocating cycle, the elements are in the position shown in phantom to the right in FIG. 16. Movement of slide arm 111 back towards the front of the dispenser effects initial contacting of upwardly extending arm 117 with the rear face 137 of pin block 130 causing it to rotate so that the needle point 135 is pivoted upwardly through bore 128 thus engaging the lowermost document by embedding point 135 therein. Continued movement in this second half of the reciprocal cycle slides the entire assembly including block 130 and plate 125 forwardly urging the leading edge of the lowermost document under the lip 107 of restrictor plate 101 and thence outwardly through aperture 106. If for any reason block 130 should fail to pivot downwardly prior to initiation of a new reciprocal cycle, shoulder 118 will engage lower ridge 138 of block 130 and force it into a downwardly pivoting movement to clear the documents before continuing in the rearward directed portion of the reciprocal cycle.

FIG. 16 also shows the inclusion of a weight plate 140 which is operable along the same general lines as described above for the other embodiments. That is, weight plate 140 is placed on the top of the stack of documents and insures sufficient weight and flush orientation of the documents so that they are embedded by needle 135 and ejected. When the last document of a stack has been removed, a downwardly extending stop bar 142 rigidly attached to the lower surface of weight plate 140 drops behind the rear edge of slide plate 125 and prevents any further reciprocal actuation of the mechanism. Although slot 121 in floor 120 and bore 128 through slide plate 125 have not been shown in FIG. 16 in the interest of clarity, their cooperative interrelationships with the other elements can be clearly seen from the exploded view of FIG. 17. It has been found that the mere forward movement of the document in withdrawal thereof from slot 106 is sufficient to disengage embedded needle point 135 and effect pivoting of block 130 around pin 129 so as to clear the floor 120 of bay 100. Preferably rear face 137 of block 130 is arranged to pivot into alignment with the rear edges of side plates 126 and 127 when the second half of forward portion of a reciprocating cycle is being effected initially thereby driving needle point 135 into the lowermost document. Thus, the forward sliding motivation is primarily transferred between upward extending arm 117 and the side plates 126 and 127 and thence to the slide plate 125 so that the entire plate and embedded document moves forwardly.

Note that slide plate 125 could be omitted by mounting side plates 126 and 127 slidably on rods extending between front and rear arms 116 and 117 of bracket 115. In such an arrangement, the mounting rods would be parallel to the floor 120 and perpendicular to the front of the document dispenser. By retaining side arms 126 and 127 in sliding relation on such bars with the pivot pin 129 attached therebetween, the needle block 130 functions in substantially the same manner as described previously in establishing contact with the lowermost document and urging it forwardly. Such a modification would further include a hole through floor 120 so that the stop bar such as 142 could be positioned to drop behind shoulder 117 to block reciprocal motion. The engagement of rear face 137 on block 130 by arm 117 to pivot block 130 upwardly and embed needle 135 into the lower document would be functioned as described above. Further, the downward pivoting of block 130 around pin 129 to clear the document as it is being withdrawn would likewise be the same. However it should be further appreciated that one advantage of the particular embodiment as shown in FIGS. 16 and 17 is that the slide plate 125 including the entire assembly of the pin block and its mounting side plates can be easily removed from the top of the container so as to facilitate access to block 130 for adjusting or replacing needle shaft 134.

Although the present invention has been described with particularity with respect to the foregoing embodiments, various modifications, additions and changes will be readily apparent to those having normal skill in the art without departing from the spirit of this invention. Further, it should be recognized that the invention can be employed for many different applications. Thus, even though the description has particularly emphasized the utility of the invention for folded map dispensing, other applications will be apparent such as dispensers of magazines, post cards, prepackaged items and the like.

What is claimed is:

1. The method of dispensing generally flat documents or the like from a stack in a container having a slot opening in the lower extremity of a vertical wall thereof, the document container having an actuator associated therewith for providing a reciprocal motion cycle of a linear forward portion and a linear backward portion, comprising the steps of:

applying a downward pressure across at least a portion of the upper surface of the uppermost document in the stack, gripping the lowermost document of the stack by embedding a pin into the lowermost document when the reciprocal motion is at the end of the forward portion, sliding the gripped lowermost document into the container aperture by coupling the linear backward motion to the embedded pin, withdrawing the pin from the lowermost document at the end of each linear backward motion portion, and maintaining the pin clear of the lowermost document for all but the last segment of each linear forward motion portion.

2. Apparatus for dispensing documents from a stack in response to a cycle of reciprocating motion from an actuator mechanism comprising:

container means for internally receiving the document stack and having front and rear vertical walls with said front wall having an aperture along the width of the bottom thereof, flat plate means positioned in the bottom of said container means and having an upwardly extending ridge of a C-shaped cross-section along the edge thereof positioned at the rear of said container in a location for engaging the lowermost document along a line at least above the vertical midpoint of the lowermost document, means coupling the reciprocating motion to said flat plate means for causing said first plate means to slide in a sequence away from and thence towards said aperture for each cycle of reciprocating motion, said rear vertical wall including means retaining any documents in said container means for permitting said C-shaped portion to be positioned beyond the rear edge of the lowermost document when said flat plate means has moved furthest away from said aperture, and adjusting plate means attached to said front vertical wall for selectably varying the height of said aperture in accordance with the thickness of the leading edge of the documents contained in a given stack, said adjusting plate means being upwardly movable for accommodating variations in thickness of a document after the leading edge thereof has passed through said aperture.

3. Apparatus in accordance with claim 2 wherein said adjusting plate means has a horizontal shoulder attached thereto which is adjustable in a vertical direction, said front vertical wall having a fixed horizontal shoulder arranged for cooperating with said adjusting plate means horizontal shoulder for providing a lowermost stop of downward movement of said adjusting plate while permitting free movement of said adjusting plate above said lowermost stop.

4. Apparatus in accordance with claim 3 which further includes weight plate means positionable on the top of the uppermost document of the stack for holding said document substantially flat, said weight plate means including a downwardly projecting arm from the lower surface thereof with said arm positioned for dropping between said C-shaped portion and said rear vertical wall for blocking any movement of said flat plate means whenever said container is depleted of documents.

5. Apparatus for removing documents from a stack in response to reciprocating motion of an actuator, comprising:

container means having a front wall and an internal wall extending in perpendicular relation to said front wall for receiving the stack of documents such that an outer document of the stack is supported in contact with one side surface of said internal wall, an aperture opening externally to said container means through said front wall in alignment with said one side surface of said internal wall, and an elongated slot through said internal wall, extending perpendicular to said aperture, that exposes a portion of the face of the document of the stack that is supported by said one side surface, engaging means normally positioned on the opposite side of said internal wall from said one side surface for engaging the exposed face portion of the document of the stack supported by said one side surface, connecting means coupling the actuator to said engaging means for imparting reciprocating motion of the actuator to said engaging means to cause said engaging means to move parallel to said internal wall in a sequence of a first motion portion away from said aperture and a second motion portion toward said aperture for each reciprocating motion of the actuator, and retaining means associated with said engagement means operable during said first motion portion for retaining said engaging means clear of the document, operable at the end of said first motion portion and during said second motion portion for moving and retaining said engaging means for extension through said slot into engagement with the exposed face portion of the document being supported by said one side surface of said internal wall to urge the document through said aperture and further operable at the end of said second motion period for withdrawing said engaging means away from engagement with said document.

6. Apparatus in accordance with claim 5 wherein the stack of documents is fed downwardly in said container means and includes a generally flat weight plate for resting upon the uppermost document of a stack, said weight plate including a stop bar pivotally attached thereto for passing through the bottom wall of said container means upon completion of a document stack for blocking further reciprocal motion of the actuator.

7. Apparatus according to claim 6, including an elongated weight bar suspended at both ends by a pair of arms, each arm being pivotally attached to the top of opposite sidewalls of said container means, whereby said weight bar can be positioned on the upper surface of said weight plate to follow the downward movement of said weight plate .

8. Apparatus in accordance with claim 5 which further includes a restrictor plate having a flared lower lip, means mounting said restrictor plate parallel to the front wall of said container means so that said lip flares outwardly from said aperture and means for biasing said restrictor plate towards said aperture so that documents urged towards said aperture by said engaging means will coact with said lip for shifting said restrictor plate against the biasing force to accommodate passage of the engaged document thereunder while blocking passage of any non-engaged document.

9. Apparatus in accordance with claim 8 wherein said restrictor plate has an extension shoulder along the edge thereof opposite to said lower lip, said mounting means including at least two rods rigidly attached relative to the front wall and in spaced relation for holding said restrictor plate parallel to the front wall, and said biasing means including a spring attached for applying a downward force to said extension shoulder.

10. Apparatus in accordance with claim 5 wherein said engaging means includes a shaft having means on one end for temporarily establishing a fixed relation with a document in the stack.

11. Apparatus in accordance with claim 10 wherein said one end of said shaft includes a pin, said reciprocating motion coupling means including a strip of spring material with said pin end of said shaft attached at one end so that said pin is directed towards said slot and means interconnecting the other end with the actuator, said retaining means including a guide means cooperative with said strip for holding said pin in extension through said slot during said second motion portion and ramp means cooperative with said strip for holding said pin out of engagement with the document of the stack during said first motion portion.

12. Apparatus in accordance with claim 11 wherein said internal wall forms a bottom for said container means with the documents being stacked on top of said internal wall, said strip has a tongue extending beyond said pin and a pair of shoulders perpendicular to the axis of said strip and extending beyond the opposite edges thereof, said guide means including a pair of surfaces in fixed spaced relation parallel to said slot for cooperating with respective said shoulders so as to hold said pin in extension through said slot during all but a last segment of said second motion portion, said retaining means further including a cam means having a sloped surface for flexing said tongue away from said slot for biasing said pin away from said slot as said strip enters said last segment of motion, said ramp means including a pair of parallel sloped edges for cooperating with said shoulders to hold said pin away from said slot during all but the last segment of said first motion portion, said pin being flexed into said slot for engaging the lowermost document of the stack when said last segment of said first motion is reached.

13. Apparatus in accordance with claim 10 wherein said retaining means includes a block having said shaft attached at a first end and means for mounting said block for pivoting said one end of said shaft into and out of said slot, said reciprocating motion coupling means including means for coupling the reciprocating motion to said block mounting means and further including means for pivoting said shaft into said slot at the beginning of said second motion portion and out of said slot at the end of said second motion portion.

14. Apparatus in accordance with claim 13 wherein said mounting means include a pivot rod positioned transverse to said slot and extending through a bore in said block, said block including first and second surfaces extending in angled relation to one another from said pivot rod with said shaft extending towards said slot from said first surface, said reciprocating motion coupling means including a shoulder engaging said second surface of said block for pivoting said shaft into said slot throughout said second motion portion, said shoulder being positioned clear of said second block surface during said first motion portion for permitting said shaft to pivot out of said slot.

15. Apparatus in accordance with claim 14 wherein said mounting means includes a pair of parallel spaced plates perpendicular to said container means internal wall and perpendicular to said front wall aperture, said pivot rod being attached between said side plates so that said shaft is between said pivot rod and said aperture, said block second surface extending beyond the rear ends of said spaced plates when said shaft is pivoted out of said slot, said reciprocating motion coupling means including a bracket having said shoulder on one end and a second shoulder on the other end with said second shoulder engaging the front ends of said spaced plates throughout said first motion portion and said first-mentioned shoulder sequentially engaging said block second surface and thence said spaced plate rear ends during said second motion portion.

16. Apparatus in accordance with claim 15 wherein said one end of said shaft is a needle point for embedding in the document overlying said internal wall in response to pivoting of said block around said rod.

17. Apparatus in accordance with claim 16 wherein said internal wall forms a bottom surface for said container means, said mounting means includes a flat plate slidably positioned on the upper surface of said container means internal wall and having said spaced plates rigidly attached thereto in downward extending relation through said slot, said flat plate having a hole therethrough between said spaced plates for accommodating movement of said needle point therethrough.

* * * * *